US006161061A

United States Patent [19]

Bessacini et al.

[11] Patent Number: 6,161,061

[45] Date of Patent: Dec. 12, 2000

[54] GUIDANCE CONTROLLER FOR A MINIMAL DISCRETE COMMAND SET

[75] Inventors: Anthony F. Bessacini, Narragansett; Robert F. Pinkos, Saunderstown, both of R.I.

[73] Assignee: The United States of America as represented by the Secretary of the Navy, Washington, D.C.

[21] Appl. No.: 09/113,012

[22] Filed: Jun. 26, 1998

[51] Int. Cl.[7] ..... G06F 165/00

[52] U.S. Cl. ..... 701/1; 701/27; 244/3.13; 244/3.15

[58] Field of Search ..... 701/1, 23, 27, 701/302; 318/589; 244/3.1, 3.11, 3.13, 3.14, 3.15, 3.19

[56] References Cited

U.S. PATENT DOCUMENTS

| | | | |
|---|---|---|---|
| 5,080,300 | 1/1992 | Stubbs et al. | 244/3.14 |
| 5,118,050 | 6/1992 | Arnold et al. | 244/3.14 |
| 5,319,556 | 6/1994 | Bessacini | 701/27 |
| 5,429,322 | 7/1995 | Waymeyer | 244/3.15 |
| 5,436,832 | 7/1995 | Bessacini et al. | 244/3.13 |
| 5,671,138 | 9/1997 | Bessacini et al. | 701/1 |
| 5,671,139 | 9/1997 | Bessacini et al. | 701/1 |
| 5,671,140 | 9/1997 | Bessacini et al. | 701/1 |
| 5,944,762 | 8/1999 | Bessacini et al. | 701/1 |
| 5,987,362 | 11/1999 | Bessacini et al. | 701/1 |

*Primary Examiner*—Gary Chin

*Attorney, Agent, or Firm*—Michael J. McGowan; Prithvi C. Lall; Michael F. Oglo

[57] ABSTRACT

A beam rider guidance system for directing a steerable object, such as a torpedo, using a limited set of discrete guidance commands. The guidance system senses a guidance point distance representing the guidance point position relative to a bearing line to a target and the rate of change of distance between the bearing line and the torpedo. Two corresponding input functions are classified into first and second sensed linguistic variables based upon membership functions from first and second different sensed variable membership function sets to become fuzzy inputs that produce fuzzy output control membership functions from a control output membership function set based upon the logical manipulation of the fuzzy inputs. These fuzzy output functions are in the form of spikes and are converted into one of a plurality of predetermined discrete commands. A tactical limiter unit selectively defines a series of situations in which commands are allowed or not allowed to reach the torpedo.

22 Claims, 11 Drawing Sheets

| $\Delta D_V$ \ e | NL | NS | ZE | PS | PL |
|---|---|---|---|---|---|
| N | NL | ZE | ZE | PS | PL |
| ZE | NL | NS | ZE | PS | PS |
| P | NL | NS | ZE | PS | PL |

* $B_V - B_C => 0$

FIG. 5A

| $\Delta D_V$ \ e | NL | NS | ZE | PS | PL |
|---|---|---|---|---|---|
| N | NL | NS | ZE | ZE | PL |
| ZE | NS | NS | ZE | PS | PL |
| P | NL | NS | ZE | PS | PL |

* $B_V - B_C =< 0$

FIG. 5B

GUIDANCE CONTROLLER FOR A MINIMAL DISCRETE COMMAND SET

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a control system located at a first site, such as a launching submarine, for guiding a steerable object, such as a torpedo, from that site toward a second site or target. More specifically, this invention relates to such a control system that operates even when both the first and second sites undergo independent motion.

(2) Description of the Prior Art

A launching submarine includes a control system for guiding a torpedo toward a target. In this particular application, the torpedo constitutes a steerable object while the submarine and target constitute first and second sites, respectively, that are capable of undergoing independent motion. One control system that has been used in submarine applications is a "corrected intercept" control system that guides a torpedo from the submarine, as the first site, toward the target, as the second site, on a collision course. Such intercept control systems generally operate with steerable objects additionally characterized by some internal homing or equivalent steering control system. In the case of a submarine launched torpedo, the corrected intercept control system directs a torpedo with an acoustic homing system toward the target. When the torpedo comes within the effective range of the homing system, steering control transfers to the homing system. Torpedoes that do not include such internal homing systems are directed to a final intercept or collision position solely by the steering control function.

Other diverse systems also control different torpedoes. In many, a wire is connected to the torpedo to maintain direct communications with a launcher submarine as the torpedo maneuvers toward a target. For example, U.S. Pat. No. 3,265,023 to Hollingsworth, Jr. et al. (1966) generally discloses the concept of maintaining communications over a wire connected between a torpedo and the launching vessel with the wire being paid out from a dispenser in the torpedo and in the launching vessel. U.S. Pat. No. 3,643,617 to Jones (1972) discloses an apparatus for guiding a torpedo along a collision course with a moving target ship. The torpedo maintains a predetermined substantially constant lead angle with respect to the target ship. The lead angle is maintained by constant adjustment of the torpedo speed as it travels toward an anticipated collision through guidance commands transferred over a communications wire. Another approach for guiding torpedoes toward a target is disclosed in U.S. Pat. No. 3,783,441 to Slawsky (1974). An air launched wire guided torpedo is controlled in response to sonobuoy signals received and processed on a surface vessel or aircraft. In this particular application communications are established through a buoy from which an electrical control cable connects to a torpedo.

Other control systems, particularly adapted for surface-to-surface or surface-to-air missiles, use a controller at one site proximate a launching site to establish a line of sight with a target. The control system maneuvers the missile along that line of sight. In U.S. Pat. No. 3,233,847 to Girsberger (1966) the line of sight defines a beam rider course, and the control system guides the remote controllable moving object along that beam rider course. The system operates by generating control guidance signals that continually correspond to a vectorial angular difference between an instantaneous line of sight to the moving object of target and an orientation axis.

U.S. Pat. No. 3,478,212 to Turck (1969) discloses an aiming system for the remote guidance of a self-propelled missile toward a target. This apparatus includes an orientable sighting instrument and an orientable electronic camera directly associated with the instrument adapted for emitting control signals for the missile and having a range of infrared spectral sensitivity different from that of the sighting instrument. An infrared source exposes both the target and the missile to radiation that embrace both ranges of sensitivity. The missile has reflecting filter means able to substantially absorb the infrared range corresponding the spectral sensitivity of this sighting means. The control system then operates on the missile to maintain a course along the line of sight beam between the launching point and the target.

U.S. Pat. No. 3,711,046 to Barhydt et al. (1973) discloses a missile guidance system in which a gunner establishes a line of sight from the gun position to the target. When a missile is launched, a source of pulsating radiant energy on the rear of the missile is detected by a guidance unit at the launching site. The guidance unit produces steering commands related to the deviation of the missile from the line of sight. Means, such as a wire interconnecting the guidance unit and the missile, transmit the guidance signals to the missile to direct it along the line of sight.

U.S. Pat. No. 4,008,869 to Weiss (1977) discloses a control system for projectile guidance and control for use against moving targets. This system (1) allows the projectile to fly a minimum energy path to target intercept, (2) applies corrective commands to the projectile as it approaches the target to correct the projectile in flight for errors in system "boresighting" and similar errors, and also to correct the ground control system on the basis of the same measurements so that these calibration errors will have a reduced degradation on the accuracy of subsequent projectiles, and (3) uses the miss sensing process to improve prediction accuracy when unguided projectiles are fired from the same launcher so that the system has both a controlled projectile and an unguided projectile capability, and both capabilities benefit from the miss sensing and data processing process.

U.S. Pat. No. 4,247,059 to Duke et al. (1981) discloses an automatic missile tracking and guidance system that guides a missile along a line of sight maintained by the operator with the target. The position of an infrared source disposed on the missile is detected. Guidance signals generated in accordance therewith control the flight of the missile along the line of sight. The infrared source comprises an array of semiconductor light emitting diodes.

U.S. Pat. No. 4,901,946 to Arnaud et al. (1990) discloses a system for guiding, by laser beam and pyrotechnic thrusters, of one of a number of carriers such as missiles which are intended to intercept maneuvering targets such as aircraft, helicopters or tanks. Guidance of the carrier is performed partly from the ground by means of a laser beam (beam-rider guidance) which tracks the target and partly be means of pyrotechnic thrusters placed on board the carrier. At each instant, the carrier "knows" its position with respect to the ideal flight path provided by the laser beam. The carrier corrects its flight path by triggering a pyrotechnic thruster when its distance with respect to the ideal flight path is greater than a predefined threshold value and when its radial velocity to the ideal path is lower than a predefined threshold.

U.S. Pat. No. 5,374,009 to Miller, Jr. et al. (1994) discloses an inertial guidance system for a missile that has no other guidance or inadequate terminal homing guidance to lock onto a target at the time of missile launch. A laser beam projected from the missile launch station is aimed toward the target. Light from the beam is reflected in random directions or scattered from aerosol particles that are ever present in the atmosphere. The scattered light strikes light detectors that are located on the sides of the missile. When the missile flies off the direction of the target, the amplitudes of impacting light on these detectors are different on different sides of the missile. Guidance controls activated by these amplitude differences cause the missile to veer toward the center of the beam and thus fly in a direction that is more toward the target.

Many of the foregoing references disclose a system known as a beam rider control system. That is, in each of many of the foregoing references a conventional control system directs a missile or torpedo along a bearing between the launching vehicle and the target. U.S. Pat. No. 5,436,832 to the inventors of this application discloses a beam rider guidance system for directing a steerable object, such as a torpedo, from a first site, such as a launching submarine, to a second site, such as a target. A guidance system senses the bearing between the first site and the second site and determines the bearing between the first site and the steerable object as it moves toward the second site. Various error signals are generated and classified into linguistic variables based upon membership functions of different sensed variable membership function sets to become fuzzy inputs to a fuzzy logic controller that produces fuzzy output membership functions from a control output membership function set based upon logical manipulation of the fuzzy inputs. These fuzzy control output membership functions are converted into an output having an appropriate form for control, subject to optional constraint to prevent unwanted trajectories. More specifically, this system measures the bearing to a guidance point, representing an effective position of detection for internal homing apparatus, and attempts to maintain the torpedo in an orientation by which the guidance point remains on the bearing line from the first site to the second site.

These and other related control systems are particularly adapted for guided missiles, torpedoes or other steerable objects wherein steering is smoothly variable between limits. However, there also exists a class of steerable objects that can only react to a limited number of prespecified course correction commands. For example, a torpedo might only be able to respond with course correction commands that define 2° and 20° port and starboard course changes. While the foregoing systems, including the fuzzy control guidance systems, provide improvements over conventional systems, even the fuzzy control systems are not readily adapted to provide a limited number of prespecified course correction commands.

SUMMARY OF THE INVENTION

Therefore it is an object of this invention to provide a fuzzy control system for controlling a device that operates with a prespecified number of course correction commands.

Another object of this invention is to provide a fuzzy control system for a steerable object that responds to a prespecified number of guidance commands.

Still another object of this invention is to provide a guidance system for directing a steerable object from a first site to a second site through the use of a limited number of prespecified discrete course correction commands.

Yet still another object of this invention is to provide a control system for guiding a torpedo from a launching vehicle to a target utilizing a prespecified number of torpedo course correction commands.

Still yet another object of this invention is to provide a control system in which fuzzy control logic produces a limited number of prespecified discrete torpedo course correction commands for guiding a torpedo along a beam rider trajectory to a target.

In accordance with one aspect of this invention, a control system guides a steerable object from a first site toward a second site by generating first and second sensed variable signals corresponding to first and second functions of the displacement or offset of the steerable object from a bearing line from the first site to the second site. A fuzzy controller generates one of a predetermined number of discrete course correction or guidance commands for controlling the steerable object in response to the first and second sensed variable signals. The guidance commands transfer to the steerable object.

In accordance with another aspect of this invention, a control system at a launching vehicle controls the trajectory of a torpedo to a target along a bearing from the launching vehicle to the target. First and second sensed variable signals corresponding to the offsets from the bearing line to each of a guidance point and a torpedo reference position are generated. A fuzzy controller generates one of a set of discrete course correction or guidance commands for controlling the steerable object in response to the first and second variable signals.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIGS. 5A and 5B schematically depict the contents of matrices in a minimal matrix rule based unit shown in FIG. 2;

DESCRIPTION OF THE PREFERRED EMBODIMENT

Figure 1:
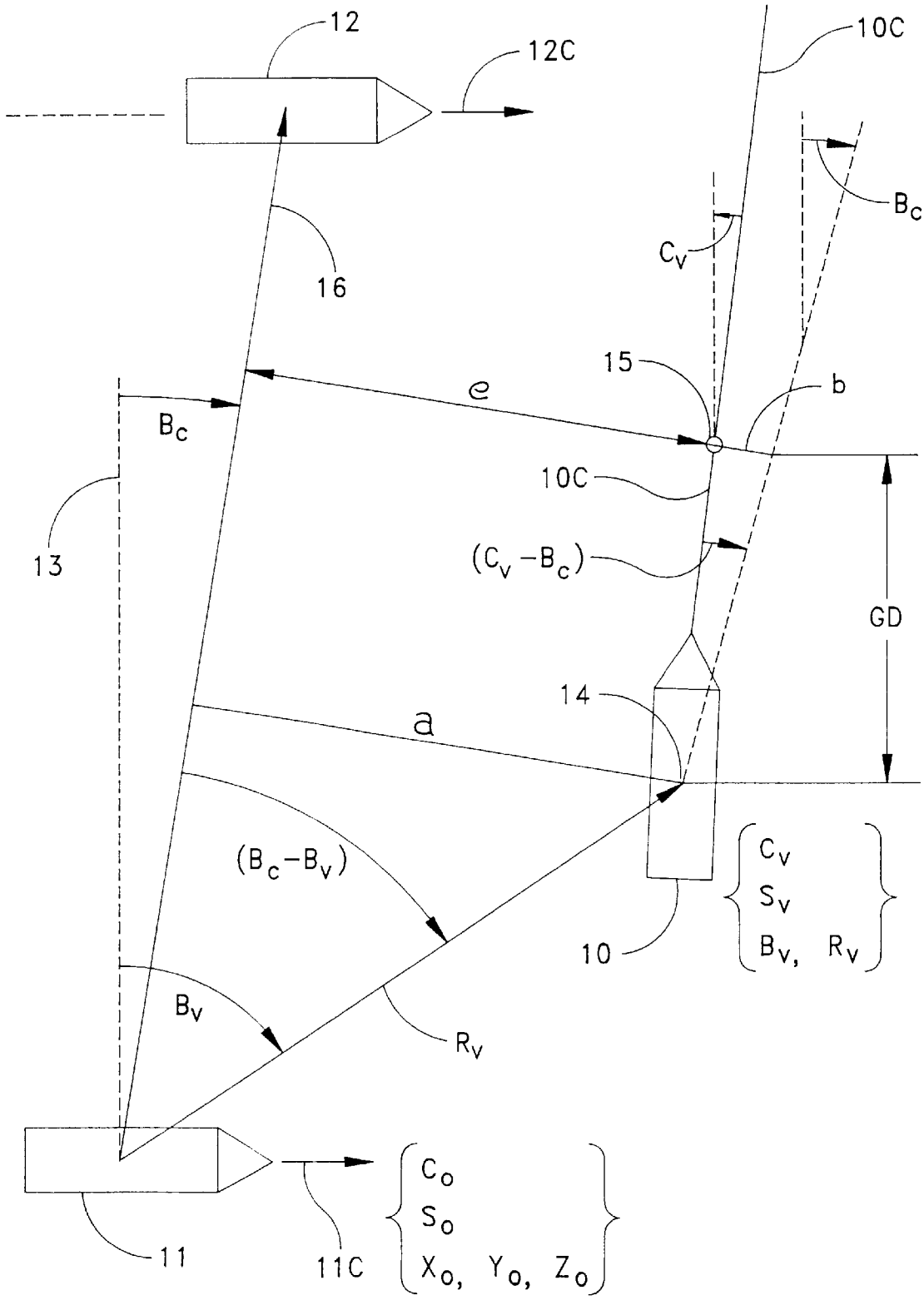
FIG. 1 depicts various relationships among a first or launching site, a second or target site and a steerable object, or torpedo, that are useful in understanding this invention.

FIG. 1 depicts a torpedo 10, as an example of a steerable object, that is moving from a first site, shown as a launching submarine 11, toward a second site, shown as a target or contact 12. The torpedo 10 has a "state" defined by its bearing ($B_V$) and range ($R_V$) with respect to the launching vehicle, its course ($C_V$) along line 10C and its speed ($S_V$). The launching submarine 11 is moving along a line 11C with a course ($C_o$) at a speed ($S_o$). The target 12 is moving along an arbitrary course at an arbitrary speed, both of which are unknown and represented by an arrow 12C. Each of these course lines 10C, 11C and 12C are normally measured with respect to some reference, such as a dashed line 13 in FIG. 1, typically magnetic north.

In this embodiment it is assumed that the torpedo 10 has a center point 14 that represents the center of its control motion and a guidance point 15 that represents the centroid of an internal acoustic homing apparatus. It is further assumed for purposes of this discussion that the only accurate measurement that can be made with respect to the target 12 is a bearing, $B_C$, to the target 12 from the launching submarine 11 along a bearing line 16.

Figure 2:
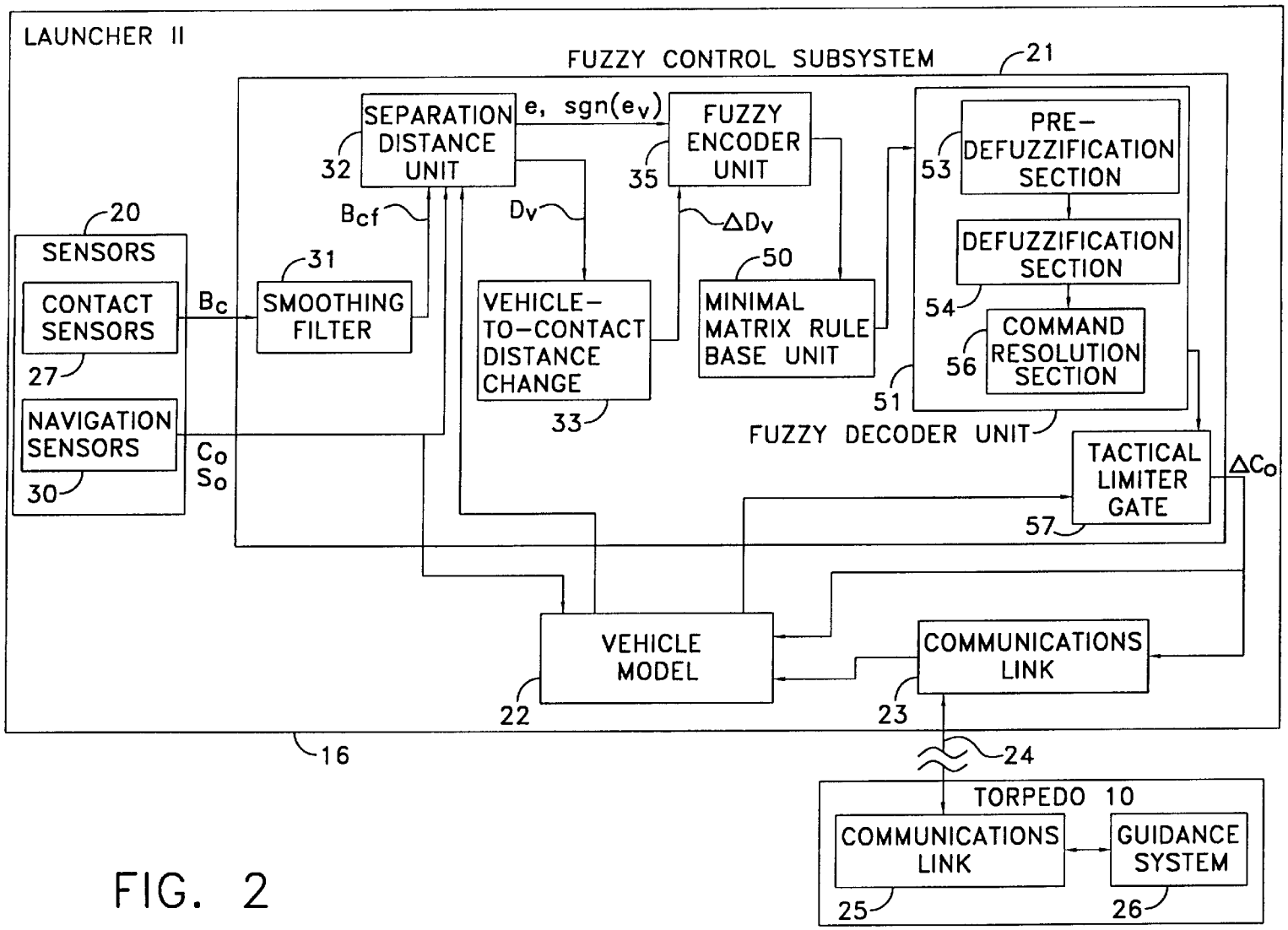
FIG. 2 is a block diagram of a beam rider guidance system constructed and operated in accordance with this invention.

Referring now to FIG. 2, a guidance system 16 at the launcher 11 constructed in accordance with this invention includes sensors 20 that measure various parameters associated with the launcher 11 and the target 12 and a vehicle model 22 that generates various parameters associated with the torpedo 10. A fuzzy control system 21 processes data from the sensors 20 and vehicle model 22 and generates first and second sensed variable signals e and $\Delta D_V$. The foregoing control system also classifies each of the sensed variable signals into one or more sensed linguistic variables from corresponding sets of predetermined sensed linguistic variables based upon their associated sensed variable membership functions. This control system 21 logically combines the selected ones of the first and second linguistic variables for identifying one or more control output linguistic variables and corresponding control output membership functions from a control output membership function set. Further processing produces a final guidance command, $\Delta C_o$. In accordance with this invention each final guidance command defines one of a predetermined number of course corrections.

A communications link 23 transfers the guidance command, $\Delta C_o$, over a bidirectional communication channel 24, typically formed by a wire between the launching vehicle 11 and another communications link 25 and a guidance system 26 in the torpedo 10. Information from the torpedo 10 also transfers through the communications link 23 to the vehicle model 22.

Referring to FIGS. 1 and 2, the sensors 20 include contact sensors 27 that produce a bearing, $B_C$, defined by the angle between the reference 13 and the bearing line 16 to the target 12. Navigation sensors 30 of FIG. 2 simultaneously define the state of the launcher 11, particularly its course, $C_o$, and speed, $S_o$. This activity occurs during step 40 in FIG. 3A that is the first step in an iterative process disclosed by the remaining steps in FIGS. 3A and 3B. That is, FIGS. 3A and 3B define each step that occurs during each iteration.

Figure 3A:
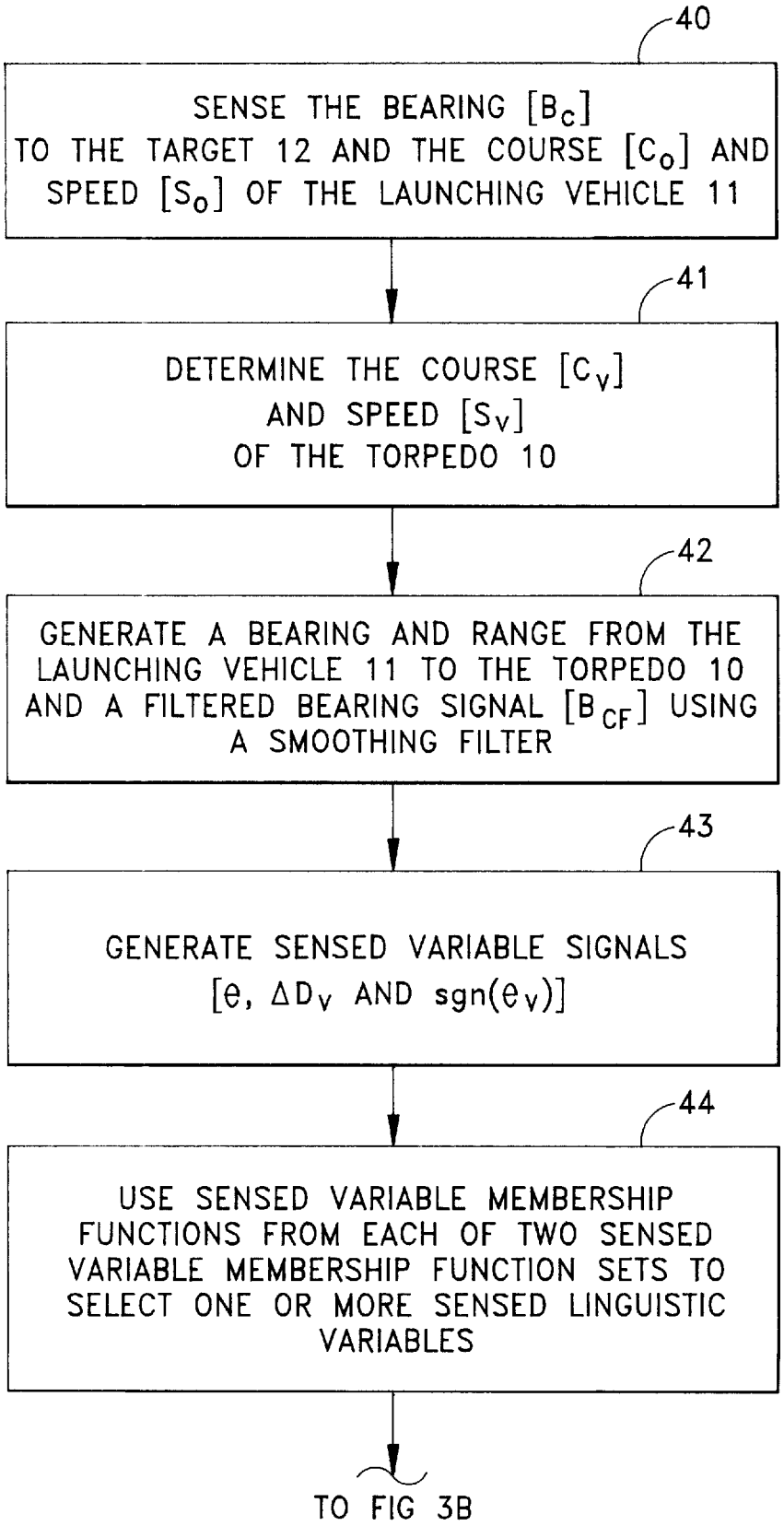
FIGS. 3A and 3B constitute a flow diagram that depicts the operation of the guidance system in FIG. 2.

In step 41 of FIG. 3A the vehicle model 22 of FIG. 2 provides the parameters defining the "state" of the torpedo 10 at any given time as inputs to the fuzzy control system 21. A $B_V$ signal and an $R_V$ signal represent the bearing and range from the launching vehicle 11 to the torpedo position 14. A $C_V$ signal represents the course of the torpedo 10. This information can be obtained utilizing the information supplied by the navigation sensors 30 with open loop or dead reckoning updates to the vehicle model 22 or supplemented with information from the torpedo 10.

Referring again to FIG. 2, the fuzzy control system 21 additionally includes a smoothing filter 31 that generates a filtered $B_{CF}$ signal as shown in step 42 of FIG. 3A. The filter minimizes the generation of commands to the vehicle that might otherwise result from noise on the measured bearing $B_C$ signal. A simple data averager can be used that operates according to:

$$B_{CF} = \frac{\sum_{i=1}^{n} B_C(i)}{n} \tag{1}$$

where $B_C(i)$ represents the "i"th measured bearing of one system update cycle and n represents the number of measured bearings during one update cycle. Any other filter that will tend to minimize any noise in this signal to produce a smooth signal representative of the bearing can be substituted.

A separation distance unit 32 utilizes the $B_{CF}$ signal from the smoothing filter 31, signals representing the state of the launching vessel from the navigation sensors 30 and the state of the torpedo from the vehicle model 22 to produce a first sensed variable signal, e, that represents a guidance point offset distance. Referring to FIG. 1, the guidance point offset distance, e, is the distance along a line perpendicular to the bearing line 16 to the guidance point 15 of the torpedo 10.

A vehicle separation distance change unit 33 generates a second sensed variable signal, $\Delta D_V$, that represents the change during successive iterations in the vehicle separation distance from the vehicle position (i.e., position 14) along a line perpendicular to the bearing line 16 from the launching vehicle 11 to the target 12. The distance change unit 33 also generates a $\mathrm{sgn}(e_V)$ signal that represents the sign of the angle between (1) the bearing to the torpedo 10 at position 14 and (2) the bearing to the target 12 along the line 16.

More specifically during step 43 of each iteration of FIG. 3A the separation distance unit 32 and the separation distance change unit 33 in FIG. 2 convert the incoming signals into the guidance point offset distance and vehicle separation distance change representing sensed variables and a sign signal as follows:

$$e = R_V \sin(B_{CF} - B_V) - GD \sin(C_V - B_{CF}) \tag{2}$$

$$\Delta D_V = R_V \sin(B_{CF} - B_V)|_k - R_V \sin(B_{CF} - B_V)|_{k-1} \tag{3}$$

$$sgn(e_V) = sgn(B_V - B_{CF}) \tag{4}$$

wherein GD is the distance between the position 14 on the torpedo and the guidance point 15, a known distance for a given torpedo.

Figure 4A:
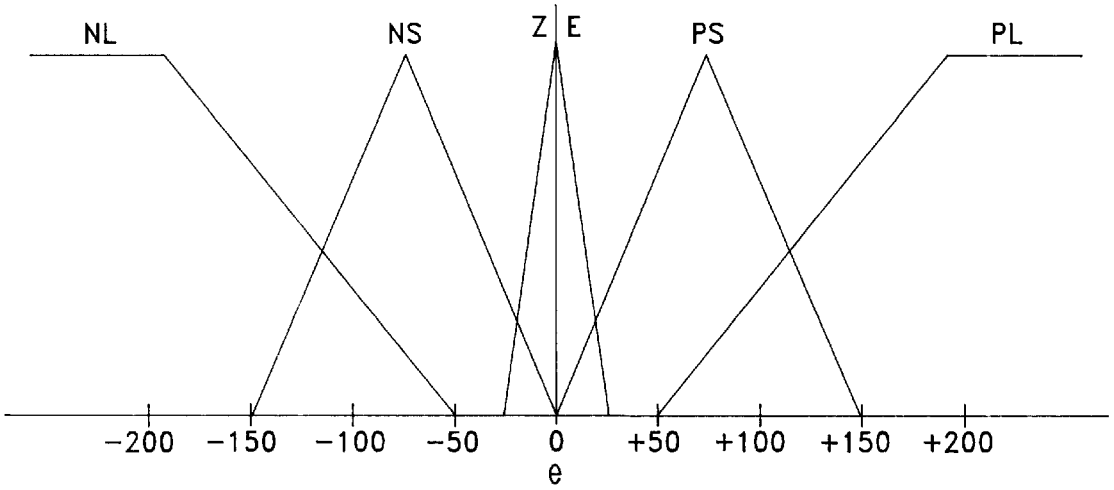
FIGS. 4A, 4B and 4C, are graphical representations of linguistic variables and their associated membership function sets that are useful in understanding this invention.
Figure 4B:
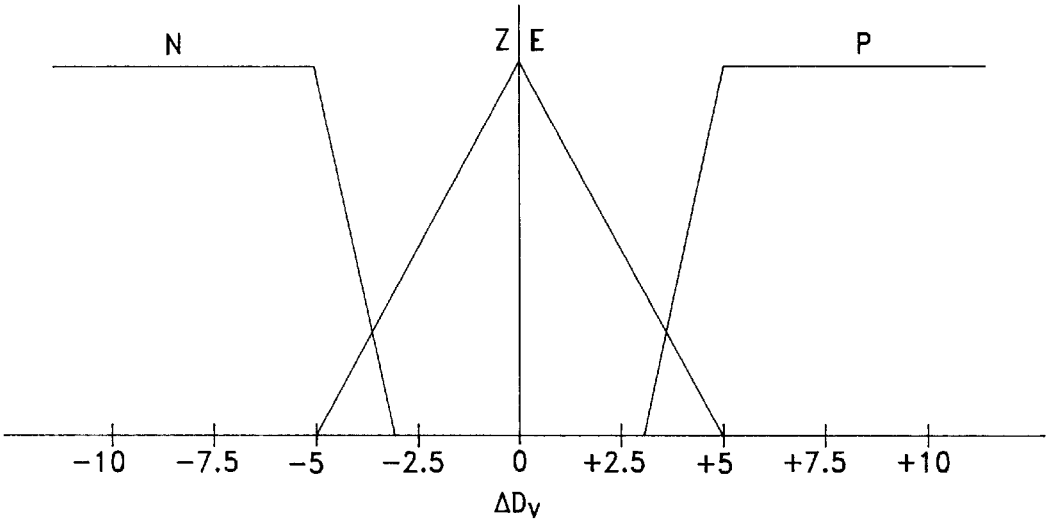

Step 44 in FIG. 3A represents a procedure by which a fuzzy encoder unit 35 in FIG. 2 converts each of the e and $\Delta D_V$ sensed variable signals from the separation distance unit 32 and separation distance change unit 33 in FIG. 2 into one or more corresponding variables based upon sensed membership functions from corresponding sensed variable membership function sets. FIG. 4A, for example, discloses the "e" sensed variable membership function set with five sensed variable membership functions and their corresponding sensed "e" or offset distance linguistic variables. FIG. 4B discloses the $\Delta D_V$ sensed variable membership function set with three $\Delta D_V$ sensed variable membership functions and their corresponding sensed $\Delta D_V$, or vehicle separation distance change or rate, linguistic variables.

Assuming that the following relationships exist:

$$x1=e \tag{5}$$

and $$x2=\Delta D_V \tag{6}$$

and $$x3=sgn(e_V) \tag{7}$$

the fuzzy encoder unit 35 in FIG. 2 utilizes the e signals to select one or more of the five available e sensed offset distance linguistic variables and the $\Delta D_V$ vehicle separation distance rate to select one or more of the three available $\Delta D_V$ sensed separation distance rate linguistic variables. The possibilities in this particular embodiment, that includes the offset distance and separation distance rate linguistic variables T(x1) and T(x2) respectively, can be designated as:

$$T(x1)=T_{x1,}{}^1T_{x1,}{}^2T_{x1,}{}^3T_{x1,}{}^4T_{x1}{}^5=(NL,NS,ZE,PS,PL) \tag{8}$$

and $$T(x2)=T_{x2,}{}^1T_{x2,}{}^2T_{x2}{}^3=(N,ZE,P) \tag{9}$$

where "NL" denotes a Negative Large sensed linguistic variable; "NS", a Negative Small sensed linguistic variable; "N" a negative sensed linguistic variable; "ZE" a zero sensed linguistic variable; "PS", a Positive Small sensed linguistic variable; "PL", a Positive Large sensed linguistic variable; and "P" a Positive sensed linguistic variable.

The specific set of membership functions $\mu$(x1) and $\mu$(x2) corresponding to the inputs x1 and x2 and the sensed offset distance and separation distance rate linguistic variables as shown in FIGS. 4A and 4B can be mathematically stated as follows:

$$\mu(x1) = \{\mu^1_{x1}, \mu^2_{x1}, \mu^3_{x1}, \mu^4_{x1}, \mu^5_{x1}\} \tag{10}$$

$$\text{and} \quad \mu(x2) = \{\mu^1_{x2}, \mu^2_{x2}, \mu^3_{x2}\} \tag{11}$$

for $j = 1$ and $i = 2, 3, 4$ and for $j = 2$ and $i = 2$ $$\mu^i_{xj} = 1 - \frac{(|xj - C^i_{xj}|)}{\delta^i_{xj}} \tag{12}$$

$$\text{for } C^i_{xj} - \delta^i_{xj} \le xj \le C^i_{xj} + \delta^i_{xj} \tag{13}$$

$$\mu^i_{xj} = 0 \tag{14}$$

$$\text{for } C^i_{xj} - \delta^i_{xj} > xj > C^i_{xj} + \delta^i_{xj} \tag{15}$$

The end conditions, j=1 and i=1,5 and j=2 and i=1,3, are defined by the following equations:

$$\mu^i_{xj} = 1 - \frac{(|xj - C^i_{xj}|)}{\delta^i_{xj}} \tag{16}$$

$$\text{for } a^iC^i_{xj} \ge a^ixj \ge a^i(C^i_{xj} - a^i\delta^i_{xj}) \tag{17}$$

$$\text{and } \mu^i_{xj} = 1 \tag{18}$$

$$\text{for } a^iC^i_{xj} < a^ixj \tag{19}$$

$$\text{and } \mu^i_{xj} = 0 \tag{20}$$

-continued $$\text{for } a^i(C^i_{xj} - a^i\delta^i_{xj}) > a^ixj \tag{21}$$

where $a^i = 1$, except for $i = 1$ where $a^1 = -1$.

FIG. 4A depicts graphically the relationship of each sensed offset distance variable and associated membership function in the e membership function set for different values of the e signal according to a specific set of values for $C^i_{xj}$ and $\delta^i_{xj}$. FIG. 4B presents analogous information for the $\Delta D_V$ signal. In the specific embodiment shown in FIGS. 4A and 4B, certain incoming signals correspond to a single or multiple sensed offset distance and sensed separation distance rate linguistic variables based upon the corresponding membership functions. For example, in FIG. 4A the e membership function set is used to encode an e sensed variable signal having a value 0 only into a ZE linguistic offset distance variable whereas a value of about −10 is encoded into both NS and ZE sensed offset distance linguistic variables. Likewise the $\Delta D_V$ membership set in FIG. 4B encodes the signal $\Delta D_V$=+4 into ZE and P sensed separation distance rate linguistic variables while a signal $\Delta D_V$=0 is encoded only as a ZE sensed separation distance rate linguistic variable.

Figure 3B:
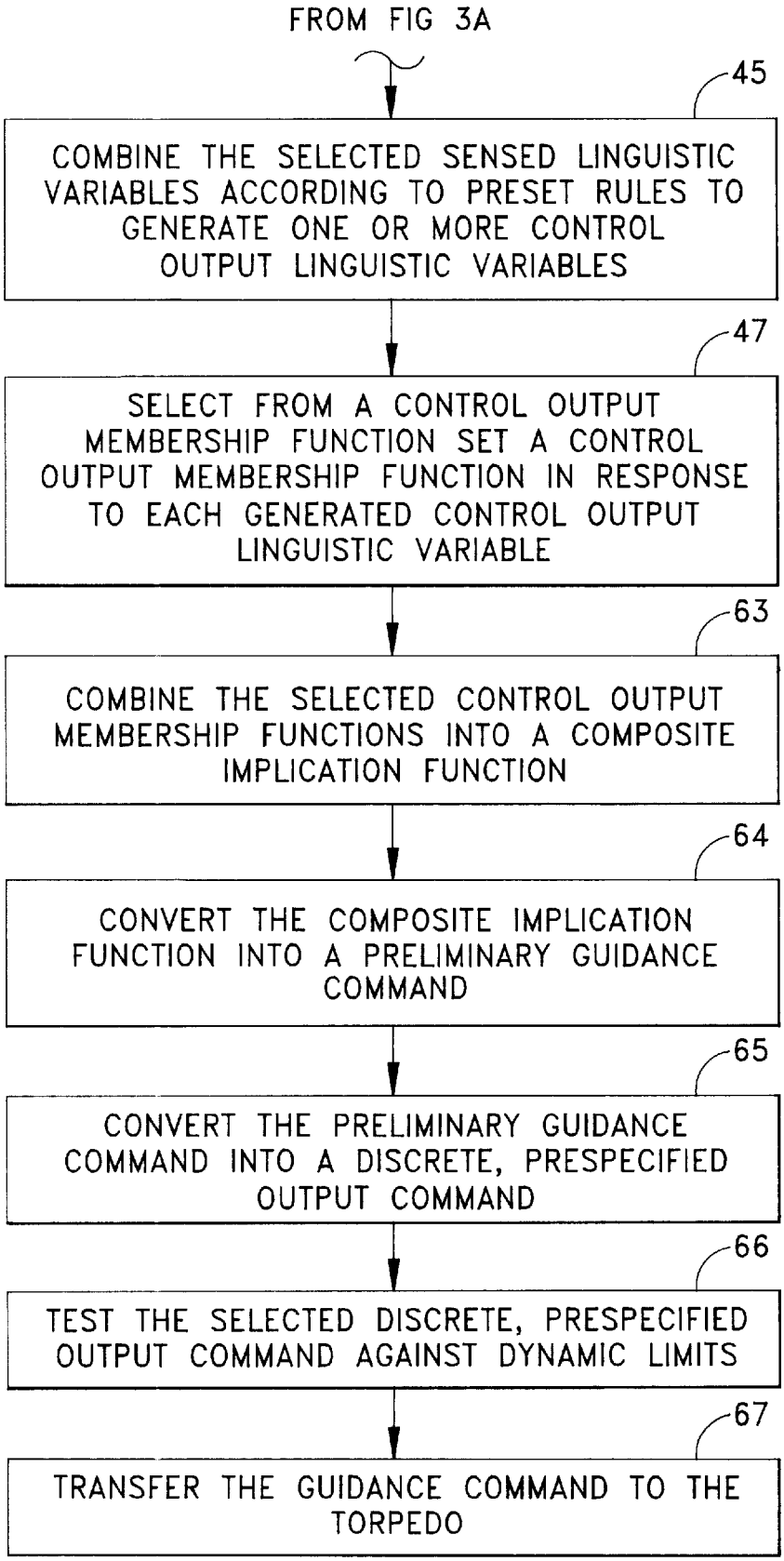

Referring now to step 45 in FIG. 3B, the minimum matrix rule base unit 50 in FIG. 2 combines the selected sensed linguistic variables according to preset rules to generate one or more control output linguistic variables. In step 47, each selected control output linguistic variable corresponds to a predefined membership function in a control output membership function set shown in FIG. 4C. Basically the system output variable or control variable is a vehicle course command ΔC and the universe of discourse for ΔC is composed of five linguistic variables defined by the following term set:

$$T(\Delta C)=(T_{\Delta C,}{}^1T_{\Delta C,}{}^2T_{\Delta C,}{}^3T_{\Delta C,}{}^4T_{\Delta C}{}^5)=(NL,NS,ZE,PS,PL). \tag{22}$$

The corresponding control output membership functions are defined as:

$$\mu(\Delta C)=\{\mu_{\Delta C,}{}^1,\mu_{\Delta C,}{}^2\mu_{\Delta C,}{}^3\mu_{\Delta C,}{}^4\mu_{\Delta C}{}^5\}. \tag{23}$$

Figure 4C:
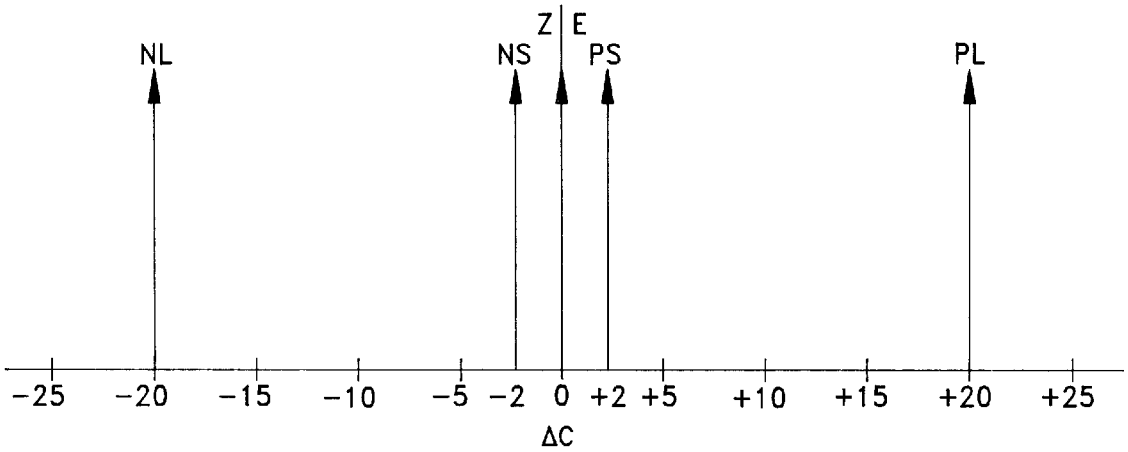

In accordance with this invention using a zero-order fuzzing model, the set of membership functions $\mu$(ΔC) corresponding to the output ΔC are singleton spikes defined by the following:

For i=1,5

$$\mu_{\Delta C}{}^i=1 \text{ for } \Delta C=C_{\Delta C}{}^i \tag{24}$$

$$\mu_{\Delta C}{}^i=0 \text{ for } \Delta C\neq C_{\Delta C}{}^i \tag{25}$$

where the values $C_{\Delta C}{}^i$ are given in Table 1 and the singletons are depicted in FIG. 4C. The values of the input membership equation constants C and δ are also given Table 1 as follows:

TABLE 1

| | $\mu$(x1) | | $\mu$(x2) | | $\mu$(ΔC) |
|---|---|---|---|---|---|
| i | $C^i_{x1}$ | $\delta^i_{x1}$ | $C^i_{x2}$ | $\delta^i_{x2}$ | $C^i_{\Delta C}$ |
| 1 | −200 | 150 | −5 | 2 | −20 |
| 2 | −75 | 75 | 0 | 5 | −2 |
| 3 | 0 | 25 | +5 | 2 | 0 |
| 4 | +75 | 75 | | | +2 |
| 5 | +200 | 150 | | | 20 |

As previously indicated, the rule base unit 50 of FIG. 2 operates according to a series of rules defined in terms of different combinations of the sensed offset distance and separation distance rate linguistic variables. The particular selection of one of the matrices in FIG. 5A or FIG. 5B is dependent on the sign of $e_V$, $\mathrm{sgn}(e_V)$, as established by equation (7) above. If the sign is positive, then the matrix in FIG. 5A is selected. Otherwise the matrix shown in FIG. 5B is selected.

In the situation shown in FIG. 1, $B_V$ is greater than $B_{CF}$ so the sign, or x3, is positive. If the fuzzy encoder unit 35 has classified the e sensed variable to have a magnitude of about 10 and the $\Delta D_V$ signal value of about +2, the fuzzy encoder unit 35 in FIG. 2 would classify the e signal into ZE and PS sensed linguistic variables and the $\Delta D_V$ signal into a ZE sensed linguistic variable. With a positive sign, the rule based unit 50 generates a ZE output function when both the e and $\Delta D_V$ sensed linguistic variables have a ZE value, and a PS output function when the e sensed linguistic variable is the PS variable and the $\Delta D_V$ sensed variable is assigned ZE sensed linguistic variable.

The rule based unit 50 in FIG. 2 utilizes all possible combinations for a given set of readings to produce an output based upon the selection of one or more control output membership functions. More specifically, when sgn $(e_V)$ is positive and if the e signals can be classified both as ZE and PS sensed linguistic variables based upon the x1 or e membership function set of FIG. 4A while the $\Delta D_V$ is encoded to a ZE sensed separation distance rate linguistic variable based upon the x2 or $\Delta D_V$ membership function set of FIG. 4B, the rule based unit 50 in FIG. 2 will correlate each of the possible two input combinations as follows:

$$\text{IF } e \text{ is } ZE \text{ AND } \Delta D_V \text{ is } ZE \text{ THEN } \Delta C \text{ is } ZE \tag{26}$$

and $$\text{IF } e \text{ is } PS \text{ AND } \Delta D_V \text{ is } ZE \text{ THEN } \Delta C \text{ is } PS \tag{27}$$

Thus in step 45 the rule based unit 50 produces different output consequences or control output linguistic variables derived from the selected rules.

A pre-defuzzification section 53 in FIG. 2 performs necessary inferencing and aggregation of the outputs for all the rules generated by the rule based unit 50. For each rule there is a fuzzy implication and an associated fuzzy implication function. The determination of the fuzzy implication functions is best explained through the use of an example. Assume $\mathrm{sgn}(e_V)$ is positive and the foregoing two rules are selected:

$$\text{IF } x1 \text{ is } T_{x1}^{3} \text{ AND } x2 \text{ is } T_{x2}^{2} \text{ THEN } \Delta C \text{ is } T_{\Delta C}^{3} \tag{28}$$

and $$\text{IF } x1 \text{ is } T_{x1}^{4} \text{ AND } x2 \text{ is } T_{x2}^{2} \text{ THEN } \Delta C \text{ is } T_{\Delta C}^{4} \tag{29}$$

The numerical strength of the output rules can be expressed respectively as:

$$\zeta_{(1)}=y_{x1}^{3}\Lambda y_{x2}^{2}=\min(y_{x1,}^{3}y_{x2}^{2}) \tag{30}$$

and $$\zeta_{(2)}=y_{x1}^{4}\Lambda y_{x2}^{2}=\min(y_{x1,}^{4}y_{x2}^{2}) \tag{31}$$

where $y_{xj}^{i}$ is $\mu_{xj}^{i}$ evaluated at a specific value of xj(t) at time t, and "Λ" denotes the fuzzy "and".

In step 63 of FIG. 3B the pre-defuzzification section 53 combines the selected control output membership functions into a composite implication function. The output composite implication function for this particular example is:

$$\mu_{\Delta C}(\Delta C)=\mu(\Delta C)_{(1)}V\mu(\Delta C)_{(2)}=\zeta_{(1)}\mu_{\Delta C}^{3}+\zeta_{(2)}\mu_{\Delta C}^{4} \tag{32}$$

where the "V" denotes the fuzzy "or".

Figure 6A:
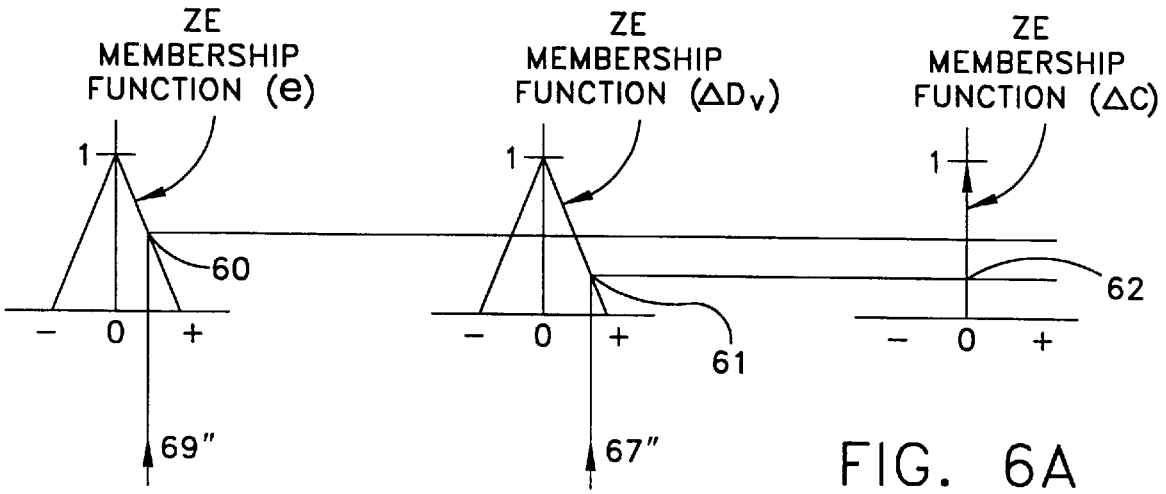
FIGS. 6A and 6B are graphs that depict the operation of the rule base unit shown in FIG. 2.
Figure 6B:
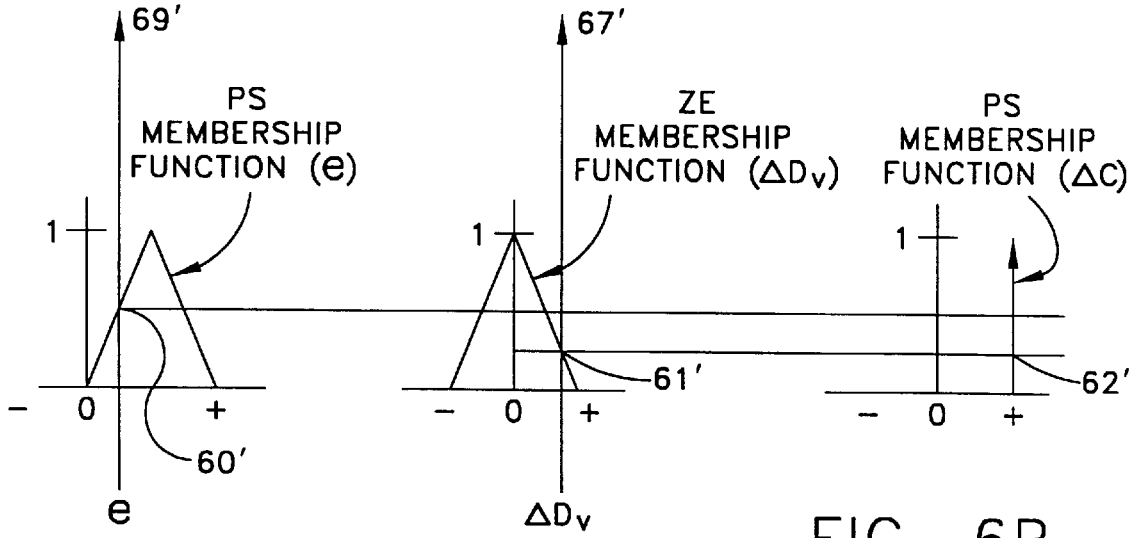

FIGS. 6A and 6B depict the generation of a composite function graphically. During the selection of the sensed linguistic variables, the fuzzy encoder unit 35 correlates each of the sensed variable signals to a particular point on a corresponding encoding sensed variable membership function. This correlation provides scaling for each control output membership function through the selection of the lower of the intercepts of the input signals with the corresponding sensed variable membership functions incorporated with a specific rule.

For example, in the first rule shown in Graph 6A the e signal intersects the ZE membership at intersection 60 having a greater magnitude than the intersection 61 of the $\Delta D_V$ signal with the ZE membership function. Consequently the $\Delta D_V$ signal controls the magnitude of the selected ZE output membership function by establishing the height of the ZE membership function at intersection 62 under the provisions of equation (30). Similarly, in FIG. 6B the magnitude of an intersection 60' of the e signal with the PS membership function is greater than the magnitude of an intersection 61' of the $\Delta D_V$ signal with the ZE membership function so the intersection 61' controls the magnitude of the PS membership function at the intersection 62' under the provisions of equation (31). As will be apparent the intersection points 61 and 61' are the same. It should be noted that lines with arrows 67" and 69" in FIG. 6A are respectively connected to the lines with arrows 67" and 69" in FIG. 6B as shown in FIGS. 6A and 6B.

As previously indicated, the pre-defuzzification section in FIG. 2 also operates in accordance with step 63 of FIG. 3B by combining the scaled fuzzy output membership functions into a composite output function that is acceptable for use in the defuzzification section 54. A number of methods can be utilized for converting composite outputs into guidance commands in step 64. Defuzzification is accomplished using a weighted average of output singletons in unit 54. Mathematically this is computed as follows:

$$\overline{\Delta C}=\frac{\sum_{k}[\zeta_{(k)}C_{\Delta C(k)}]}{\sum_{k}\zeta_{(k)}} \tag{33}$$

where $\Sigma_{(k)}$ is the summation over all the rules selected by the rule based unit 50 and $C_{\Delta C(k)}$ denotes the output of the kth rule consequent.

Figure 7:
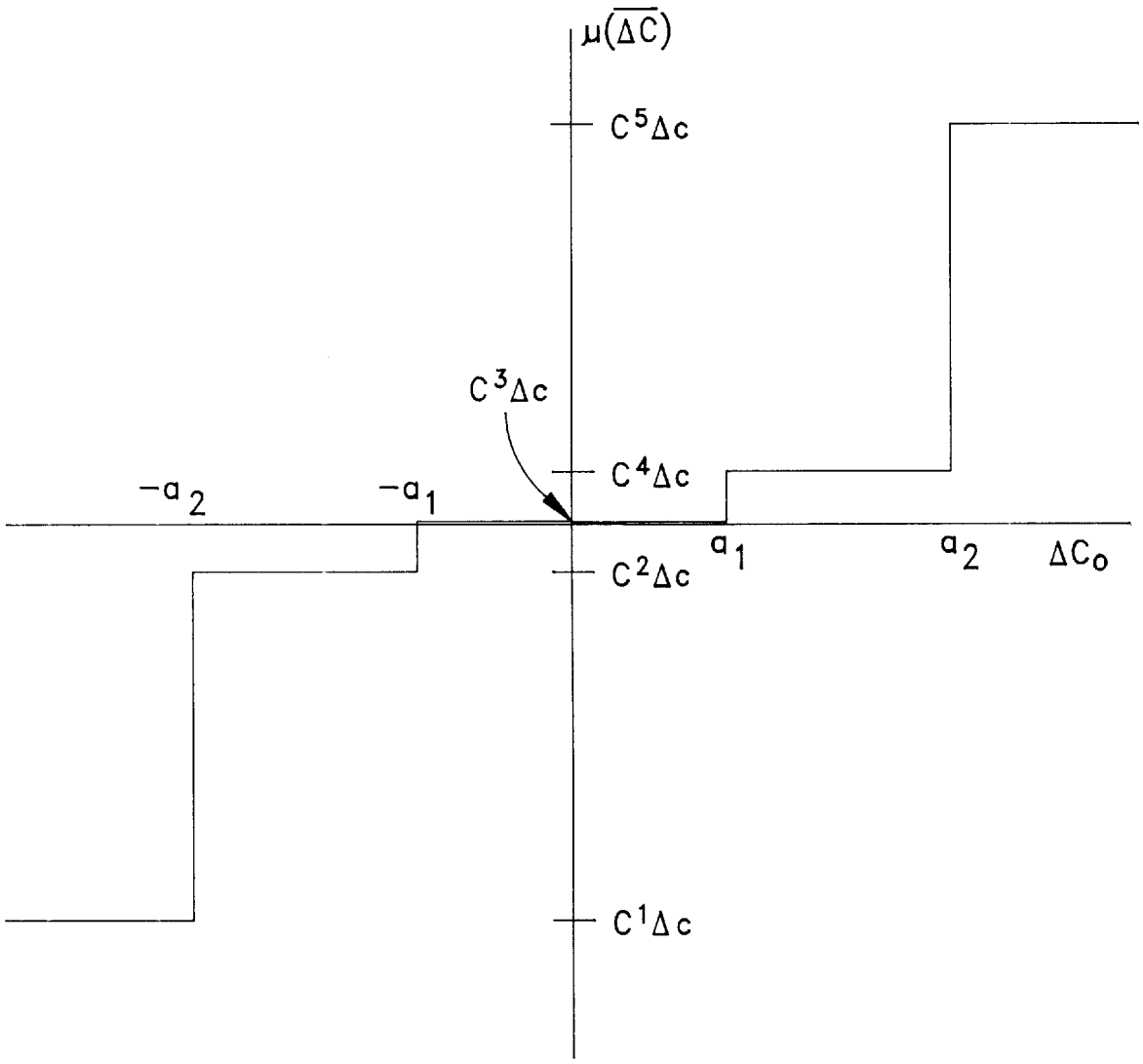
FIG. 7 depicts the operation of a command resolution unit in FIG. 2.

The command resolution section 56 converts the finite output $\overline{\Delta C}$ from the defuzzification section 54, as a preliminary guidance command, to one of a plurality of prespecified discrete commands $\mu(\overline{\Delta C})$ in step 65 (FIG. 3B). FIG. 7 depicts this process graphically; and it is stated mathematically as follows:

$$\text{If } \overline{\Delta C}\leqq -a_2 \text{ Then } \mu(\overline{\Delta C})=C_{\Delta C}^{1} \tag{34}$$

$$\text{If } -a_2<\overline{\Delta C}\leqq -a_1 \text{ Then } \mu(\overline{\Delta C})=C_{\Delta C}^{2} \tag{35}$$

$$\text{If } -a_1<\overline{\Delta C}<a_1 \text{ Then } \mu(\overline{\Delta C})=C_{\Delta C}^{3} \tag{36}$$

$$\text{If } a_1\leqq\overline{\Delta C}<a_2 \text{ Then } \mu(\overline{\Delta C})=C_{\Delta C}^{3} \tag{37}$$

$$\text{If } \overline{\Delta C}\geqq a_2 \text{ Then } \mu(\overline{\Delta C})=C_{\Delta C}^{5} \tag{38}$$

The outputs from $C_{\Delta C}^{1}$ through $C_{\Delta C}^{5}$ could correspond to, in this particular embodiment, five discrete outputs such as "port 20°", "port 2°", "0°", "starboard 2°"and "starboard 20°"course correction or guidance commands.

A tactical limiter unit 57 processes the resulting $\mu(\overline{\Delta C})$ discrete output to provide the final output command in step 66 of FIG. 3B. The tactical limiter unit 57 in FIG. 2 responds to signals from the vehicle model 22 to determine if the command being analyzed exceeds limits that are governed by the tactical situation. These limits ensure that the resultant torpedo trajectory will not have a velocity component in the direction of the launching vehicle 11. If the command violates this condition, it will not be sent to the torpedo. More specifically and as graphically depicted in FIG. 8, the tactical limiter circuit 57 receives the $\mu(\overline{\Delta C})$ input and compares it against limits +L1 and −L2 to transform the input into the $\Delta C_0$ output. A direct correspondence exists so long as the signal is intermediate the +L1 and −L2 limits. If those limits are exceeded, no output results.

Figure 8:
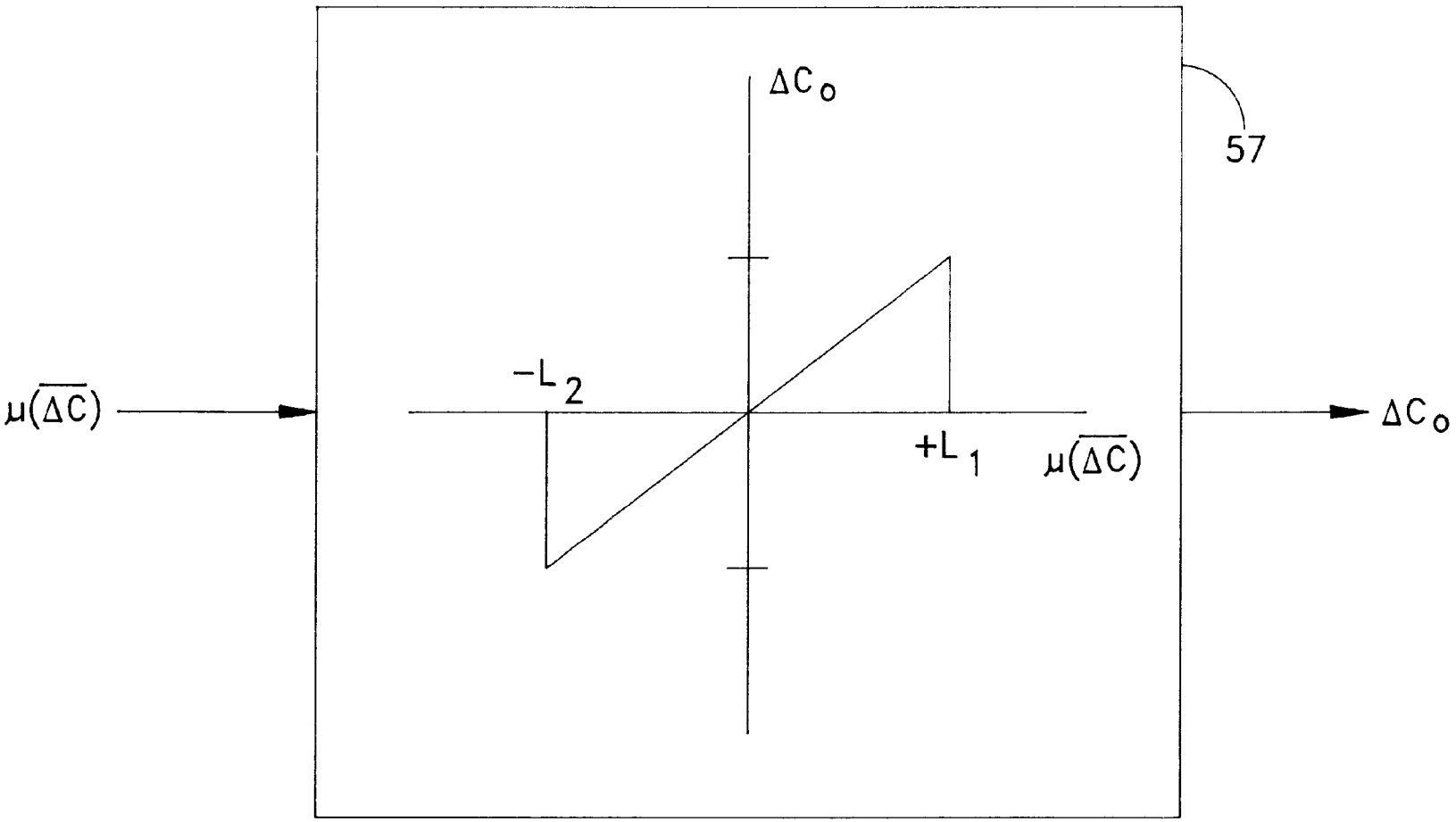
FIG. 8 depicts a tactical limiter unit shown in FIG. 2.

Since the course command limits are dependent on the instantaneous tactical situation, the limits are updated during each iteration by processes that are well known in the art. That is, the limits vary or are dynamic. Thus FIG. 8 represents a particular set of limits for a particular situation. If the torpedo were travelling on a course perpendicular to bearing line 16 in FIG. 1, the +L1 limit might be at the zero axis of FIG. 8 while the L2 limit might revert back beyond the −20° position.

The resulting $\Delta C_0$ output or course correction command then is sent from the fuzzy control system 21 as shown in FIG. 2 to the communications link 23 for transfer to the torpedo 10. Step 67 in FIG. 3B represents this procedure.

Figure 9A:
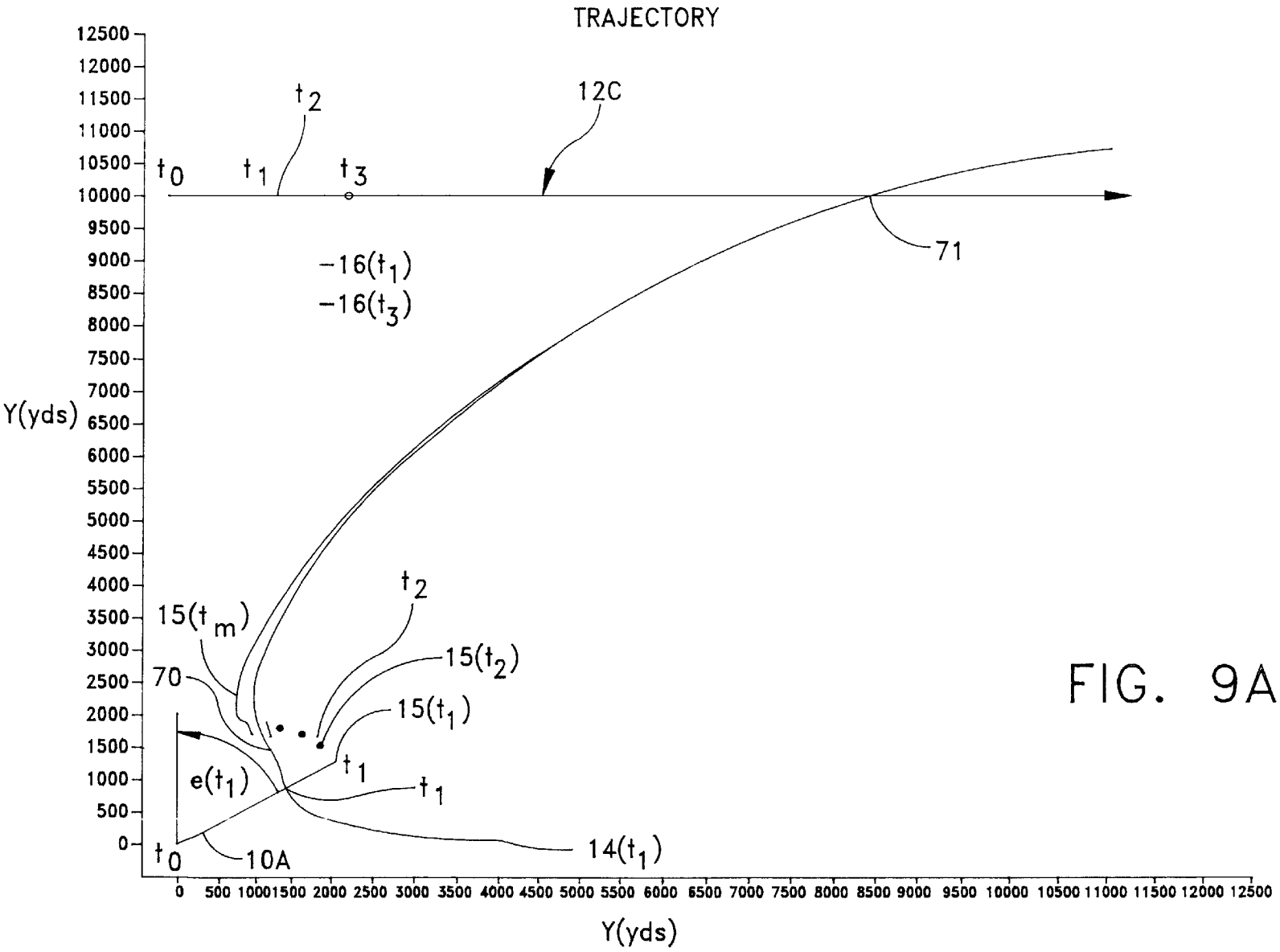
FIGS. 9A and 9B depict the operation of a guidance system shown in FIG. 2.
Figure 9B:
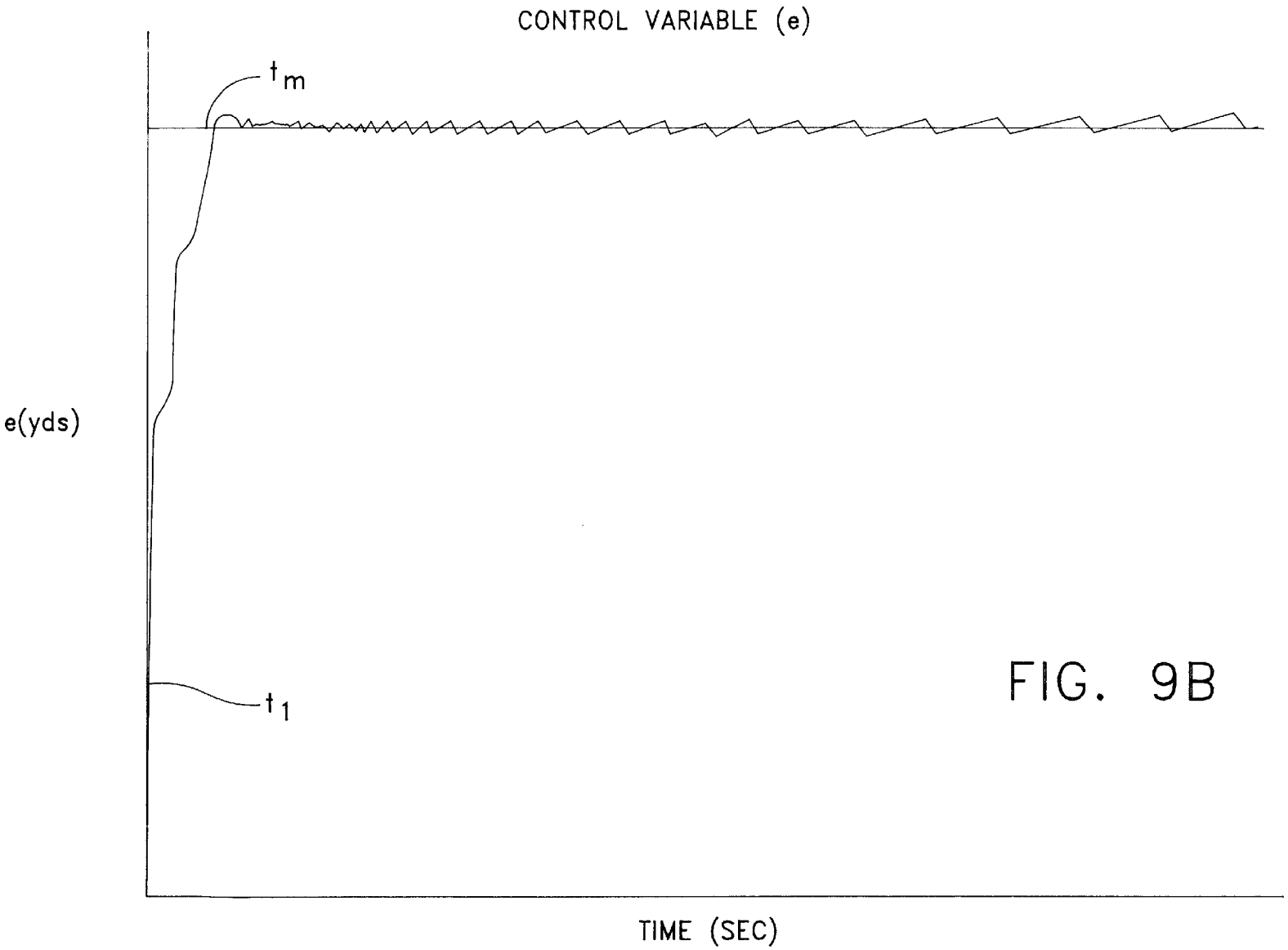

FIG. 9A depicts the trajectory 12C of a target beginning at time $t_0$ at the launch of the torpedo along an initial course represented by line 10A. This course is maintained for a predetermined time to a point marked as time $t_1$, applied to the tracks 10A and 12C. At time $t_1$, the torpedo reference position 14($t_1$) defines the torpedo position while point 15($t_1$) depicts the position of the guidance point 15. At $t_1$ control by the system 16 in FIG. 2 commences. Assuming that the launching vehicle remains stationary at the launch point, the guidance point 15 is well to right of the bearing line 16($t_1$). Consequently the distance defines an e($t_1$) signal that is encoded into the NL based on the e membership functions and the $\Delta D_V(t_1)$ signal falls under the N membership function as the torpedo bearing angle will be increasing. As the sgn($e_V$) signal is positive, the output control function from FIG. 5A is an NL function that will produce a turn to port of 20°. The incremental rotation is represented at $t_2$ by the 15($t_2$) guidance point position. During successive iterations the trajectory of the torpedo 10 turns so the torpedo trajectory as represented by position 14 follows along a line section 70 until the e signal turns positive at time $t_m$. At this point the control e variable shifts to a PS value and initiates a gradual turn to starboard. Thereafter an analysis will indicate that the course correction commands will oscillate between the port 2° and starboard 2° discrete course correction commands at longer and longer intervals until the guidance point 15 intercepts the track 12C at point 71.

In summary, a fuzzy control beam rider system constructed in accordance with this invention has several features. First a filtered contact bearing line is used with the vehicle guidance point position to form a guidance point offset distance signal, e, and an offset distance change signal, $\Delta D_V$, representing the change in distance between the torpedo and the contact bearing line. The vehicle guidance point offset distance and the offset distance change signals are converted to fuzzy inputs by the fuzzy encoder unit 35 in FIG. 2. Based on these inputs and the sign of the angle between the target bearing and the contact bearing, a minimal matrix rule based unit 50 invokes appropriate rules to determine the resultant fuzzy output actions. These rules are contained in matrices in FIGS. 5A and 5B. A predefuzzification section 53 takes all the outputs of the selected rules and determines a composite fuzzy function. A defuzzification unit 54 converts the signals into a numerical value that is a preliminary output command. The command resolution unit 56 selects one of prespecified discrete course correction commands capable of being sent to the vehicle in response to the preliminary output command. The tactical limiter gate 57 can interrogate each command to determine if it meets appropriate, dynamic tactical constraints. If it does, the resultant course correction command (ΔC) is sent to the torpedo 10. It is also provided to update the vehicle model 22 in FIG. 2.

Consequently it has been found that a beam rider trajectory control system incorporating this invention utilizes error criteria that enable the control of a tactically more significant parameter, namely the offset distance from the bearing line rather than the bearing error. Unlike other systems, the control system of this invention works with a minimal discrete output command set which is characteristic of many present torpedo systems. This system has demonstrated robust behavior and has the inherent capability of being tuned using experimental data from new situations.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A system at a first site for guiding a steerable object from the first site toward a second site comprising:

input means for generating first and second sensed variable signals corresponding to first and second functions of the distance between the steerable object and a bearing line from the first site to the second site;

fuzzy control means for generating a preliminary guidance command for controlling the steerable object in response to the first and second sensed variable signals;

means for generating a final guidance command for controlling the steerable object in response to the preliminary guidance command; and means for transferring the guidance command to the steerable object.

2. A guidance system as recited in claim 1 wherein said fuzzy control means comprises:

encoding means for converting each of the first and second sensed variable signals into first and second sensed linguistic variables selected from corresponding first and second linguistic variable sets;

selection means responsive to the sensed linguistic variables from said encoding means for producing a preliminary control output based upon the selection of at least one of a set of control output linguistic variables; and means for generating the preliminary guidance command in response to the preliminary control output from said selection means.

3. A guidance system as recited in claim 2 wherein the first function is an offset distance and the second function is a rate of change of a separation distance and said input means includes:

means for determining an offset distance of a predetermined position on the steerable object from the bearing line; and means for determining a rate of change in the offset distance of said predetermined position on the steerable object from the bearing line.

4. A guidance system as recited in claim 2 wherein the first function is an offset distance and the second function is a rate of change of said offset distance and said input means includes:

means for determining first and second offset distances from the bearing line to first and second predetermined positions respectively relative to the steerable object; and means for determining a rate of change in the offset distance of the second predetermined position on the steerable object from the bearing line.

5. A guidance system as recited in claim 2 wherein said input means includes:

means for sampling a bearing from the first site to the second site; and smoothing filter for averaging the sampled bearings to obtain a smoothed bearing signal representing a smoothed bearing from the first site to the second site.

6. A guidance system as recited in claim 5 wherein said input means additionally includes means for converting the smoothed bearing signal into a first variable signal representing a distance from the smoothed bearing to the steerable object and a second variable signal representing the rate of change of a distance from the smoothed bearing to the steerable object.

7. A guidance system as recited in claim 5 wherein the steerable object includes first and second reference positions and said input means additionally includes:

separation distance means for converting the smoothed bearing signal into a first variable signal representing an offset distance from the smoothed bearing to the first reference position on the steerable object; and separation distance change means for converting the smoothed bearing signal into a second variable signal representing the rate of change of an offset distance from the smoothed bearing to the second reference position on the steerable object.

8. A guidance system as recited in claim 2 wherein the steerable object responds to a discrete set of prespecified course correction commands and wherein said means for generating a final guidance command includes means for converting the preliminary guidance command from said fuzzy control means into one of the prespecified course correction commands.

9. A guidance system as recited in claim 1 wherein a target undergoing independent motion constitutes the second site, a torpedo with a reference point designating its position constitutes the steerable object and a torpedo launching vehicle undergoing independent motion constitutes the first site and wherein said guidance system input means comprises:

means for generating a bearing signal representing the bearing from the launching vehicle to the target;

means for generating the torpedo state including course, position and speed of the torpedo;

distance separation means responsive to said bearing signal generating means and said torpedo state generating means for generating a signal representing the distance of the torpedo reference point from the measured bearing line; and separation change means responsive to said bearing signal generating means and said torpedo state generating means for generating a signal representing a rate of change of the distance.

10. A guidance system as recited in claim 9 wherein said torpedo is characterized by a guidance point as a second reference point that leads a first reference point by a predetermined distance and wherein said distance separation means measures the offset distance from the measured bearing line to the guidance point and the separation change means measures the rate of change of the offset distance between the bearing line and the first reference point.

11. A guidance system as recited in claim 10 wherein $R_V$ represents the distance from the launching vehicle to the torpedo, $B_{CF}$ represents the bearing from the launching vehicle to the target, $B_V$ represents the bearing from the launching vehicle to the torpedo, GD represents the distance from the first reference point to the second reference point and $C_V$ represents the course of the torpedo and wherein:

said distance separation means generates a first sensed variable, e, according to:

$$e=R_V \sin(B_{CF}-B_V)-GD \sin(C_V-B_{CF});$$

said separation change means generates a distance change signal, $\Delta D_V$, according to:

$$\Delta D_V=R_V \sin(B_{CF}-B_V)|_k-R_V \sin(B_{CF}-B_V)|_{k-1};$$

and said system additionally comprises means for determining a sign function, $\mathrm{sgn}(e_V)$, according to:

$$\mathrm{sgn}(e_V)=sgn(B_V-B_{CF}).$$

12. A guidance system as recited in claim 9 wherein the torpedo responds to commands representing discrete course corrections and said means for generating a final guidance command includes means for converting the preliminary guidance command into one of said discrete course correction commands.

13. A guidance system as recited in claim 9 wherein the torpedo responds to commands representing discrete course corrections and said means for generating a final guidance command includes command resolution means for comparing the preliminary guidance command to a predefined set of values that correspond to each of a plurality of predetermined discrete course correction commands to convert the preliminary guidance command into one of said predetermined discrete course correction commands.

14. A guidance system as recited in claim 13 wherein a conversion means additionally includes means for comparing the predetermined discrete course correction commands from said command resolution means for compliance with the limits prior to the transfer of the final guidance command to the torpedo.

15. A guidance system as recited in claim 13 wherein a conversion means additionally includes means for comparing a plurality of discrete output commands from said command resolution means for compliance with dynamic limits prior to the transfer of the final guidance command to the torpedo.

16. A method for guiding a torpedo with a reference point designating its position from a torpedo launching vehicle undergoing independent motion toward a target undergoing independent motion comprising:

generating a bearing signal representing the bearing from the launching vehicle to the target;

generating a torpedo state including course, position and speed of the torpedo;

generating a signal representing an offset distance of the torpedo from the measured bearing line in response to the bearing signal and the torpedo state;

generating a signal representing the rate of change of a separation distance in response to the bearing signal and the torpedo state;

generating by fuzzy logic means a preliminary guidance command for controlling the torpedo in response to the offset distance and the rate of change of the separation distance;

generating a guidance command for controlling the torpedo in response to the preliminary guidance command; and transferring the guidance command to the torpedo.

17. A guidance method as recited in claim 16 wherein said torpedo is characterized by a guidance point as a second reference point that leads a first reference point by a predetermined distance and wherein:

said step of generating a signal representing the offset distance measures the distance from the measured bearing line to the guidance point; and the step of generating the signal representing the rate of change of a separation distance measures the rate of change of the distance between the bearing line and the first reference point.

18. A guidance method as recited in claim 17 wherein $R_V$ represents the distance from the launching vehicle to the torpedo, $B_{CF}$ represents the bearing from the launching vehicle to the target, $B_V$ represents the bearing from the launching vehicle to the torpedo, GD represents the distance from the first reference point to the second reference point and $C_V$ represents the course of the torpedo and wherein:

the step of generating a signal representing the offset distance produces a variable "e" according to:

$$e=R_V \sin(B_{CF}-B_V)-GD \sin(C_V-B_{CF});$$

the step of generating the rate of change of a separation distance produces a variable "$\Delta D_V$" according to:

$$\Delta D_V=R_V \sin(B_{CF}-B_V)|_k-R_V \sin(B_{CF}-B_V)|_{k-1};$$

and said method comprises an additional step of determining a sign function, $sgn(e_V)$, according to:

$$sgn(e_V)=sgn(B_V-B_{CF}).$$

19. A guidance method as recited in claim 16 wherein the torpedo responds to commands representing discrete course corrections and said step of generating the guidance command includes converting the preliminary guidance command into one of said discrete course correction commands.

20. A guidance method as recited in claim 16 wherein the torpedo responds to commands representing discrete course corrections and said step of generating a guidance command includes converting the preliminary guidance command into one of said discrete course correction commands by comparing the preliminary guidance command to a predefined set of values that correspond to each of the discrete course correction commands.

21. A guidance method as recited in claim 20 wherein said conversion step additionally includes comparing a plurality of discrete output commands from a command resolution means for compliance with the limits prior to the transfer of the final guidance command to the torpedo.

22. A guidance method as recited in claim 20 wherein said conversion step additionally includes comparing a plurality of discrete output commands from a command resolution means for compliance with dynamic limits prior to the transfer of the final guidance command to the torpedo.

* * * * *